US010301876B2

(12) United States Patent
Savage et al.

(10) Patent No.: US 10,301,876 B2
(45) Date of Patent: May 28, 2019

(54) DRILLING TOOL BEARING AND DRIVETRAIN ASSEMBLY

(71) Applicant: Halliburton Energy Services, Inc., Houston, TX (US)

(72) Inventors: John Keith Savage, Edmonton (CA); Steven Graham Bell, Red Deer (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/526,293

(22) PCT Filed: Dec. 12, 2014

(86) PCT No.: PCT/US2014/069978
§ 371 (c)(1),
(2) Date: May 11, 2017

(87) PCT Pub. No.: WO2016/093857
PCT Pub. Date: Jun. 16, 2016

(65) Prior Publication Data

US 2017/0335628 A1 Nov. 23, 2017

(51) Int. Cl.
*E21B 4/00* (2006.01)
*E21B 4/02* (2006.01)
(Continued)

(52) U.S. Cl.
CPC ..... *E21B 4/02* (2013.01); *E21B 4/003* (2013.01); *E21B 44/00* (2013.01); *F03C 2/22* (2013.01)

(58) Field of Classification Search
CPC ..... E21B 4/02; E21B 4/003; E21B 44/00
See application file for complete search history.

(56) References Cited

U.S. PATENT DOCUMENTS 4,478,244 A * 10/1984 Garrett ..... E21B 21/106 137/327
5,248,204 A 9/1993 Livingston et al.
(Continued)

FOREIGN PATENT DOCUMENTS

CN 1073740 6/1993
CN 101864893 10/2010
(Continued)

OTHER PUBLICATIONS

International Search Report and Written Opinion of PCT Application No. PCT/US2014/069978 dated Aug. 27, 2015: pp. 1-14.

*Primary Examiner* — David J Bagnell
*Assistant Examiner* — Yanick A Akaragwe
(74) *Attorney, Agent, or Firm* — Chamberlain Hrdlicka

(57) ABSTRACT

A downhole drilling motor, system, and method for using same are disclosed. A downhole drilling motor can include a power section stator having a first end, a second end, an internal cavity passing therethrough. The downhole drilling motor can further include a rotor assembly positioned and fully encased in the internal cavity. The rotor assembly includes a power section rotor, a drivetrain operably coupled to the power section rotor and a bearing set. The power section rotor is positioned at the first end within the internal cavity of the power section stator. The power section rotor, the drivetrain, and the bearing set are fully encased in the internal cavity of the power section stator. Additional apparatuses, systems, and methods are disclosed.

18 Claims, 5 Drawing Sheets

(51) Int. Cl.
*E21B 44/00* (2006.01)
*F03C 2/22* (2006.01)

(56) References Cited

U.S. PATENT DOCUMENTS

| | | | | |
|---|---|---|---|---|
| 5,343,964 | A | 9/1994 | Leroy | |
| 6,142,228 | A * | 11/2000 | Jogi | E21B 4/02 166/250.01 |
| 2002/0074167 | A1 | 6/2002 | Plop | |
| 2004/0119607 | A1 * | 6/2004 | Davies | E21B 4/02 340/854.4 |
| 2006/0086536 | A1 | 4/2006 | Boyle et al. | |
| 2013/0277116 | A1 | 10/2013 | Knull et al. | |
| 2013/0299243 | A1 | 11/2013 | von Gynz-Rekowski et al. | |
| 2013/0313022 | A1 * | 11/2013 | Kirkhope | E21B 4/02 175/104 |
| 2014/0332275 | A1 | 11/2014 | Murray et al. | |
| 2015/0122549 | A1 * | 5/2015 | Hohl | E21B 4/02 175/57 |

FOREIGN PATENT DOCUMENTS

| | | |
|---|---|---|
| CN | 202926511 | 5/2013 |
| RU | 2011778 | 4/1994 |
| RU | 2304688 | 8/2007 |
| RU | 118675 | 7/2012 |
| WO | 03042488 | 5/2003 |
| WO | 2014098899 | 6/2014 |

* cited by examiner

DRILLING TOOL BEARING AND DRIVETRAIN ASSEMBLY

BACKGROUND

Mud motors are used to supplement drilling operations by converting fluid power into mechanical torque and applying this mechanical torque to a drill bit. Mud motors operate under very high pressure and high torque conditions, and mud motors can fail in predictable ways at identifiable stress points. Ongoing efforts are directed to improving fatigue endurance and lowering the cost of servicing mud motors.

DETAILED DESCRIPTION

To address some of the challenges described above, as well as others, some embodiments of a mud motor are described herein.

Figure 1:
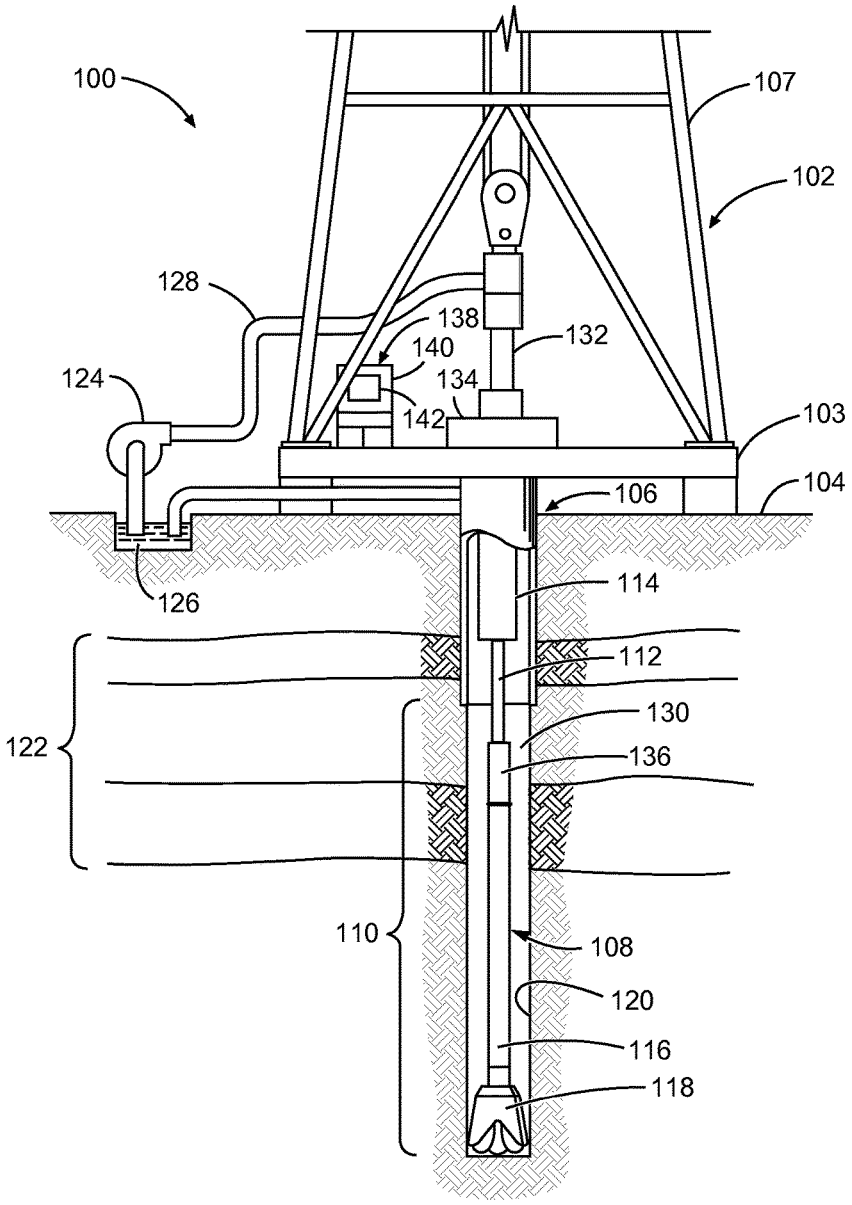
FIG. 1 is a block diagram of a drilling system according to some embodiments.

FIG. 1 illustrates a drilling system 100 in which some embodiments can be implemented. A drilling rig 102 is located at the surface 104 of a well 106. A drilling platform 103 is equipped with a derrick 107. The drilling rig 102 provides support for a drill string 108. The drill string 108 may include a bottom hole assembly 110, perhaps located at the lower portion of the drill pipe 112.

The bottom hole assembly 110 may include drill collars 114, a downhole tool 116, and a drill bit 118. The drill bit 118 may operate to create the borehole 120 by penetrating the surface 104 and the subsurface formations 122. The downhole tool 116 may comprise any of a number of different types of tools including measurement-while-drilling (MWD) tools, logging-while-drilling (LWD) tools, and others.

The drill collars 114 may be used to add weight to the drill bit 118. The drill collars 114 may also operate to stiffen the bottom hole assembly 110, allowing the bottom hole assembly 110 to transfer the added weight to the drill bit 118, and in turn, to assist the drill bit 118 in penetrating the surface 104 and subsurface formations 122.

During drilling operations, a mud pump 124 may pump drilling fluid (sometimes known by those of ordinary skill in the art as "drilling mud") from a mud pit 126 through a hose 128 into the drill pipe 112 and down to the drill bit 118. The drilling fluid can flow out from the drill bit 118 and be returned to the surface 104 through an annular area 130 between the drill pipe 112 and the sides of the borehole. The drilling fluid may then be returned to the mud pit 126, where such fluid is filtered. In some embodiments, the drilling fluid can be used to cool the drill bit 118, as well as to provide lubrication for the drill bit 118 during drilling operations. Additionally, the drilling fluid may be used to remove subsurface formation cuttings created by operating the drill bit 118.

During drilling operations, the drill string 108 (perhaps including the Kelly 132, the drill pipe 112, and the bottom hole assembly 110) may be rotated by the rotary table 134. In addition, or alternatively, the bottom hole assembly 110 may be rotated by a motor 136 (e.g., a mud motor) that is located downhole. The mud motor 136 can be a positive displacement motor (PDM) assembly, which can include a SperryDrill® or SperryDrill® XL/XLS series PDM assembly available from Halliburton of Houston, Tex. The mud motor 136 can include a multi-lobed stator (not shown in FIG. 1) with an internal passage within which is disposed a multi-lobed rotor (not shown in FIG. 1). The PDM assembly operates according to the Moineau principle whereby when pressurized fluid is forced into the PDM assembly and through the series of helically shaped channels formed between the stator and rotor, the pressurized fluid acts against the rotor causing nutation and rotation of the rotor within the stator. Rotation of the rotor generates a rotational drive force for the drill bit 118.

Directional drilling may also be performed by rotating the drill string 108 while contemporaneously powering the mud motor 136, thereby increasing the available torque and drill bit speed. The drill bit 118 may take on various forms, including diamond-impregnated bits and specialized polycrystalline-diamond-compact (PDC) bit designs, such as the FX and FS Series™ drill bits available from Halliburton of Houston, Tex., for example.

The mud motor 136 must be able to withstand loads that arise in two drilling operational modes: "on-bottom" loading, and "off-bottom" loading. On-bottom loading corresponds to the operational mode during which the drill bit 118 is boring into a subsurface formation under vertical load from the weight of the drill string 108, which in turn is in compression; in other words, the drill bit 118 is on the bottom of the wellbore. Off-bottom loading corresponds to operational modes during which the drill bit 118 is raised off the bottom of the wellbore and the drill string 108 is in tension (i.e., when the bit is off the bottom of the wellbore and is hanging from the drill string 108, such as when the drill string 108 is being "tripped" out of the wellbore, or when the wellbore is being reamed in the uphole direction). Tension loads are also induced when circulating drilling fluid with the drill bit 118 off-bottom, due to the pressure drop across the drill bit 118 and bearing assembly (not shown in FIG. 1).

Figure 2A:
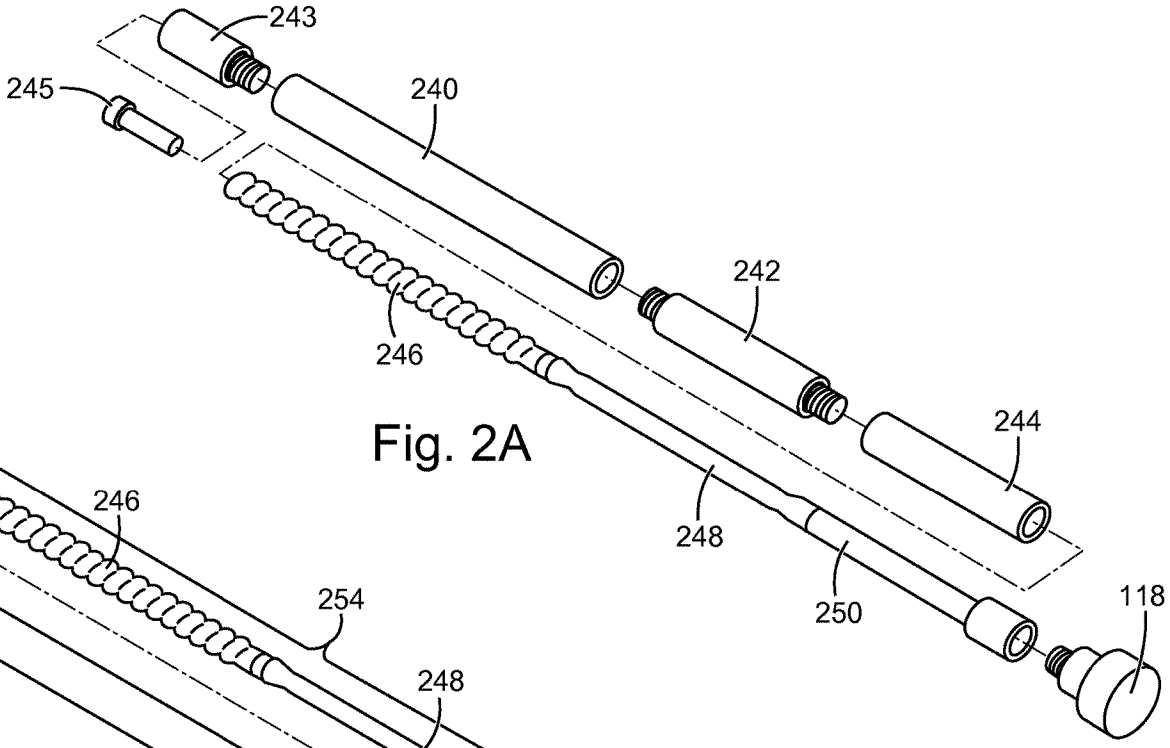
FIG. 2A I is an exploded view of a portion of a mud motor as can be used in some available systems for purposes of comparison to mud motors of some embodiments.
Figure 2B:
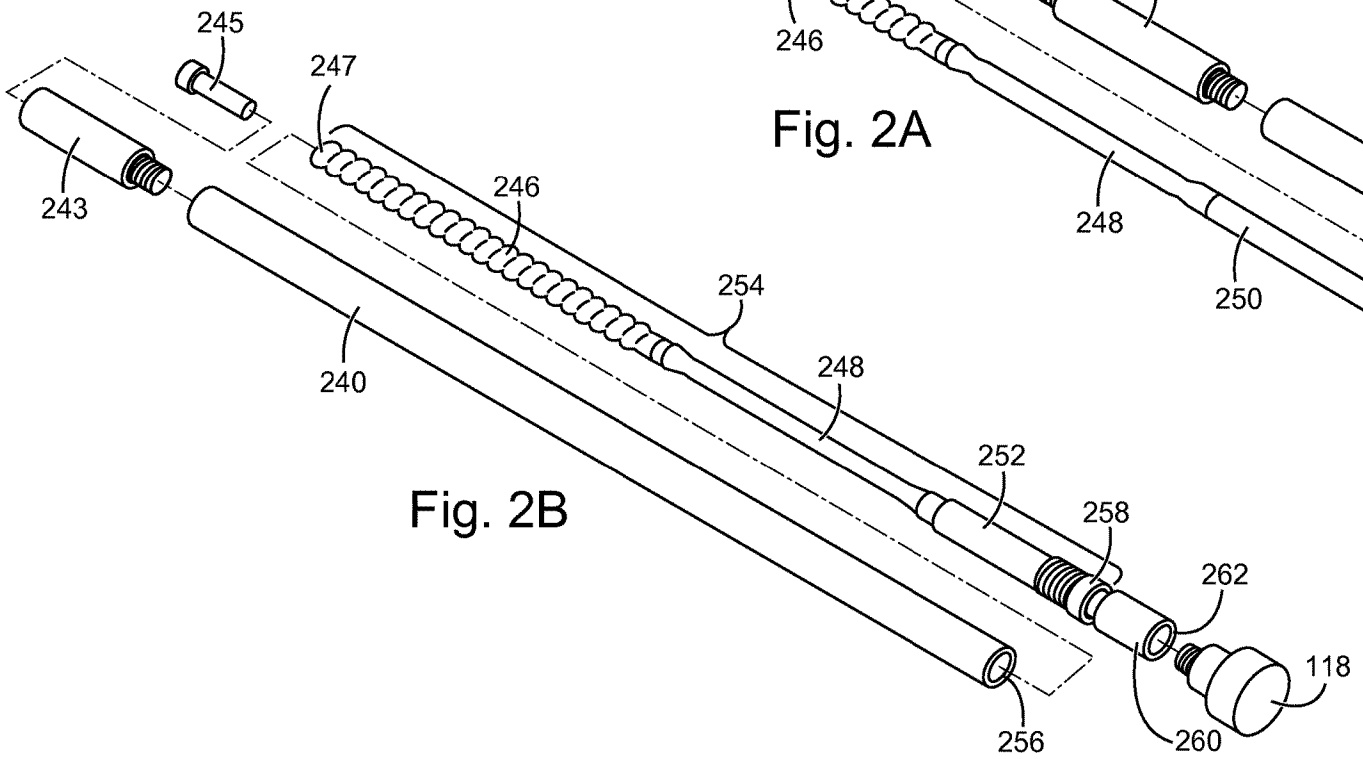
FIG. 2B is an exploded view of a portion of a mud motor in accordance with some embodiments.

Mud motors 136 in accordance with various embodiments can withstand the above-described loads without experiencing premature fatigue failures. FIG. 2A is an exploded view of a portion of a mud motor 136 as can be used in some available systems for purposes of comparison with example embodiments. FIG. 2B is an exploded view of a portion of a mud motor 136 in accordance with some embodiments.

As shown in FIG. 2A, a currently available mud motor 136 includes a power section stator 240. The power section stator 240 can connect to a flex housing 242 through, for example, threading. The flex housing 242 can further be connected to a bearing pack 244. The power section rotor 246 can be coupled to the drill bit 118 via the drivetrain 248 driveshaft 250 and drill bit 118 such that the eccentric power from the power section rotor 246 is transmitted as concentric power to the drill bit 118. In this manner, the mud motor 136 can provide a drive mechanism for the drill bit 118 which is at least partially and, in some instances, completely independent of any rotational motion of the drill string 108 (FIG. 1).

The drill bit 118 is coupled to the end of the driveshaft 250 according to methods understood by those of ordinary skill in the art to perform, for example, any of the drilling operations described earlier herein with reference to FIG. 1, or other drilling and exploration operations. The power section rotor 246, drivetrain 248, and driveshaft 250 is assembled inside the power section stator 240, flex housing 242, and bearing pack 244. The mud motor 136 can further include a saver subassembly 243 coupled at the first end of the power section stator 240 and a rotor catcher 245.

In contrast, embodiments illustrated in FIG. 2B eliminate housing connections, which are predictable sources of fatigue failure, below the top end of the power section stator 240. Embodiments accomplish this through the use of a cartridge system of mounting, wherein bearings are assembled into a bearing set 252. Embodiments provide a way of retaining the bearing set 252, the drivetrain 248, and the power section rotor 246 in a loadable cartridge without high-failure housing connections, while still permitting service access to these components.

The power section stator 240 includes a first (e.g., "uphole") end, a second (e.g., "downhole") 256 end, and a cavity passing therethrough. The power section rotor 246 includes rotor lobes 247 to cooperate with one or more stator lobes (not shown in FIG. 2B) of the power section stator 240.

In embodiments, the drivetrain 248 is operably coupled to the power section rotor 246, and bearing set 252, and the bearing set 252 has a driveshaft partially enclosed therein (not shown in FIG. 2B). The power section rotor 246, drivetrain 248, bearing set 252, and driveshaft portion are preassembled into a loadable rotor assembly 254 to be fed into a downhole end 256 of the power section stator 240 and fully encased in the internal cavity of the power section stator 240. The bearings in the bearing set 252 can include roller-type bearings, although embodiments are not limited thereto. Further, the bearings can include polycrystalline diamond (PCD) materials although embodiments are not limited to PCD materials.

A tonging area 258 and tool joint 260 portion of the driveshaft 250 are outside of the power section stator 240. The tonging area 258 is an area that is accessible to a set of tongs or wrench jaws that can grip the driveshaft 250 immediately above the tool joint 260 for the purposes of tightening or loosening the tool joint. In some embodiments, the tongs can also grip at the tool joint 260 depending on whether the thread above or below the tool joint 260 is to be broken out. The drill bit 118 is coupled to the bottom of the driveshaft 250. The connection 262 between the drill bit 118 and driveshaft 250 can include an American Petroleum Institute (API) drill string rotary shouldered connection with a tapered end.

The rotor assembly 254 is retained within the power section stator 240 such that the power section rotor 246, drivetrain 248 and bearing set 252 with driveshaft can reliably carry power section torque and react to drilling loads within the power section stator 240. As will be appreciated upon comparing FIG. 2A and FIG. 2B, example embodiments eliminate connections within the power section stator 240, thereby reducing or eliminating sources of fatigue at connections and extending the life of the power section stator 240 and of the mud motor 136 generally. Such a cartridge system of mounting can have other benefits in assembly related to pre-assembly and bench testing of rotor assembly 254 components. Ways of retaining the rotor assembly 254 within the power section stator 240 are described in more detail later herein with reference to FIG. 3.

Figure 3:
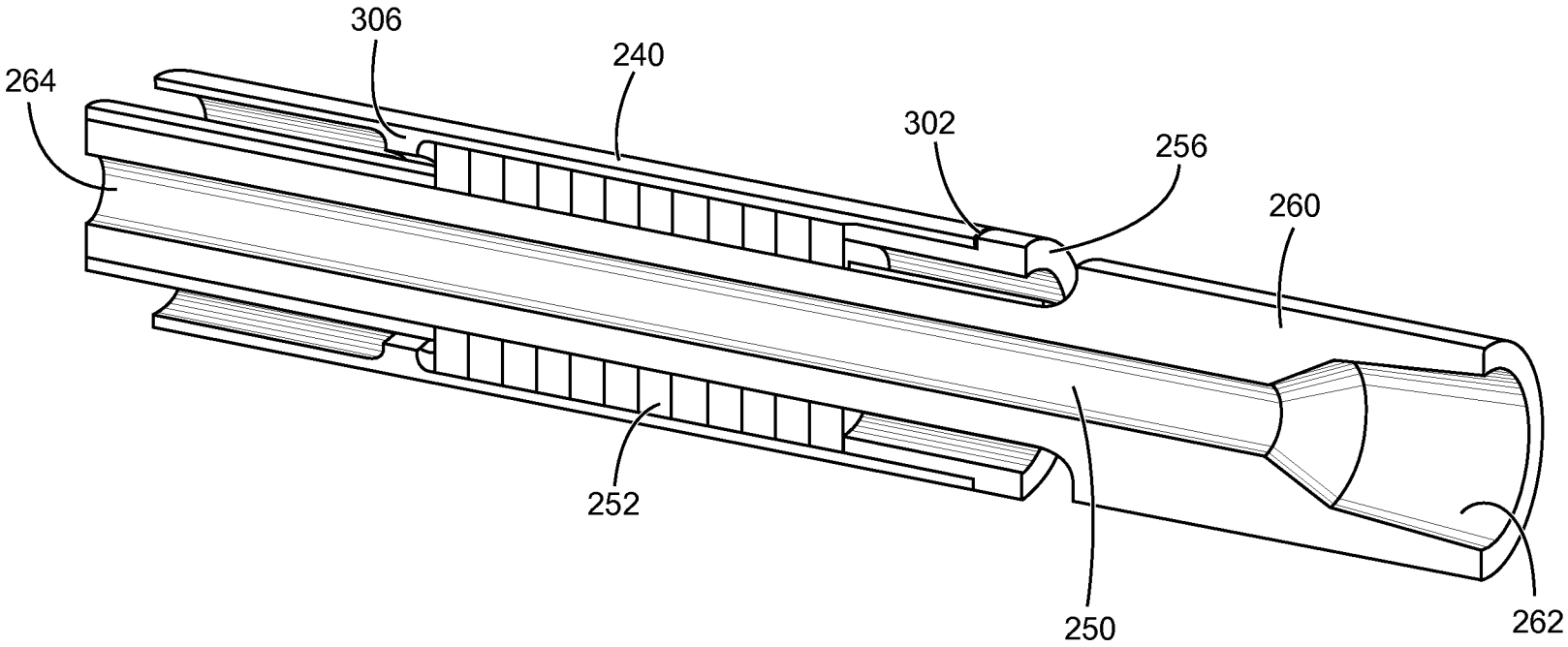
FIG. 3 is a schematic diagram of a portion of a mud motor in accordance with some embodiments.

FIG. 3 is a schematic diagram of a portion of a mud motor in accordance with some embodiments. FIG. 3 provides an alternate view for depicting how the rotor assembly 254 (not shown in FIG. 3) can be fed into an open, downhole end 256 of the power section stator 240. A retaining assembly 302 (e.g., a threaded bushing) at the downhole end 256 of the power section stator 240 can retain the rotor assembly 254 (not shown in FIG. 3) including the bearing set 252, at the downhole end 256 inside the internal cavity of the power section stator 240. The tool joint 260 and connection 262 are also shown in FIG. 3.

The retaining assembly 302, by virtue of being located at the end of the power section stator 240, will not be subjected to bending loads and therefore will not be subject to at least some sorts of fatigue failures that could reduce the endurance life of the power section stator 240. The retaining assembly 302 can include threading to allow for use of a threaded bushing circumferentially coupled around an inside circumference or outside circumference of the power section stator 240, although embodiments are not limited thereto. The retaining assembly 302 can include other types of retention components described later herein, for example, the retaining assembly 302 can include compression rings coupled around the inside circumference or outside circumference of the downhole end of the power section stator 240.

In at least some embodiments, the retaining assembly 302 can carry large off-bottom loads and on bottom loads into the power section stator 240 through the bearing set 252 when the drill bit 118 (FIGS. 1 and 2B) is off bottom or back reaming. The retaining assembly 302 can also provide a strong load path for a driveshaft catch feature for loss prevention that radially constrains power section rotor 246 movement within the power section stator 240. For example, on bottom loading would follow a load path into the power section stator 240 and could be handled by the bearings of the bearing set 252. Off-bottom loading would follow a path into the threaded bushing into the power section stator 240. Some embodiments can include a driveshaft catch feature that includes split rings retained by the retaining assembly 302 such that axial movement of the driveshaft 250 (not shown in FIG. 3) out of the power section stator 240 causes an upset feature of the driveshaft 250 to engage the split rings retained by the retaining assembly 302, thereby retaining the rotor assembly 254 inside the end of the power section stator 240.

In some embodiments, the retaining assembly 302 would not include any threaded connection and instead would engage the smooth power section stator 240 wall. A wedging tapered lock type feature (not shown in FIG. 3), understood by those of ordinary skill in the art for mounting shaft equipment, could be used to expand and engage the inside wall of the power section stator 240. At least these embodiments could further include an undercut (not shown in FIG. 3) of the inside wall of the power section stator 240 to prevent the locking mechanism from becoming displaced from the inside of the power section stator 240. The expansion could be accomplished with fasteners parallel to the axis of the tool and arranged in a radial array about the shaft. These fasteners could be tightened using, for example, an Allen wrench or other similar hand tool.

Other embodiments could permit expansion using an expanding retaining ring seated in a shallow groove. Once expanded and engaging the power section stator 240 inside wall, a jacking feature such as jacking bolts could be utilized to provide appropriate bearing race preloads. Some embodiments can preload the bearings directly in the rotor assembly 254 and utilize the retention feature to locate the rotor assembly 254 and carry loads into the power section stator 240.

In these or other embodiments, instead of or in addition to the retaining assembly 302, a shoulder 306 can be used to retain the rotor assembly 254 within the power section stator 240. The shoulder 306 can be shoulder portion spaced a distance from a second end 264 inside the internal cavity. In embodiments using a shoulder 306, the power section stator 240 would be manufactured to include a shoulder 306 on the inside diameter of the power section stator 240, which can increase the complexity of the manufacturing process of the power section stator 240. Further, inclusion of a shoulder 306 would produce a stress riser that could cause fatigue-related failures of components of the rotor assembly 254. In contrast, embodiments using threading or other retaining assembly 302 types place any stress raising features at the bottom of the power section stator 240 in an area not subjected to bending stress. It is to be appreciated that bending stress tends to be highly cyclical due to rotation in the hole and is one of the primary failure drivers in mud motors 136 for downhole drilling.

Figure 4A:
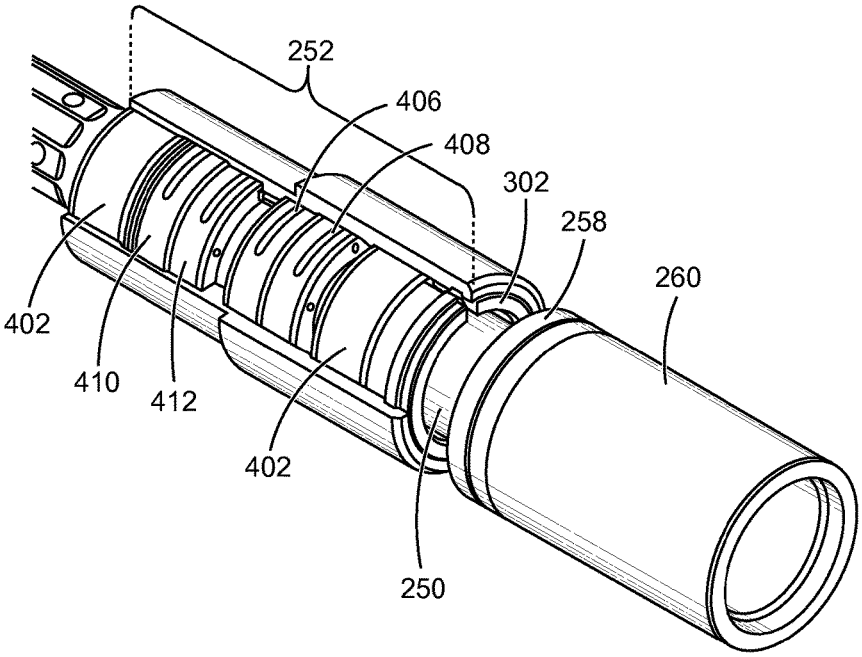
FIG. 4A is a perspective view of a portion of a mud motor with a section cut away to reveal coupling of a bearing set portion in accordance with some embodiments.

FIG. 4A is a perspective view of a portion of a mud motor 136 with a section cut away to reveal coupling of a bearing set 252 in accordance with some embodiments. The bearing set 252 includes PDC-based radial bearings 402 (housing side is shown), on-bottom axial bearings 406, 408, and off-bottom axial bearings 410, 412. FIG. 4A further depicts placement of the retaining assembly 302 and driveshaft 250 with tonging area 258 and tool joint 260 extending from outside the bearing set 252.

Figure 4B:
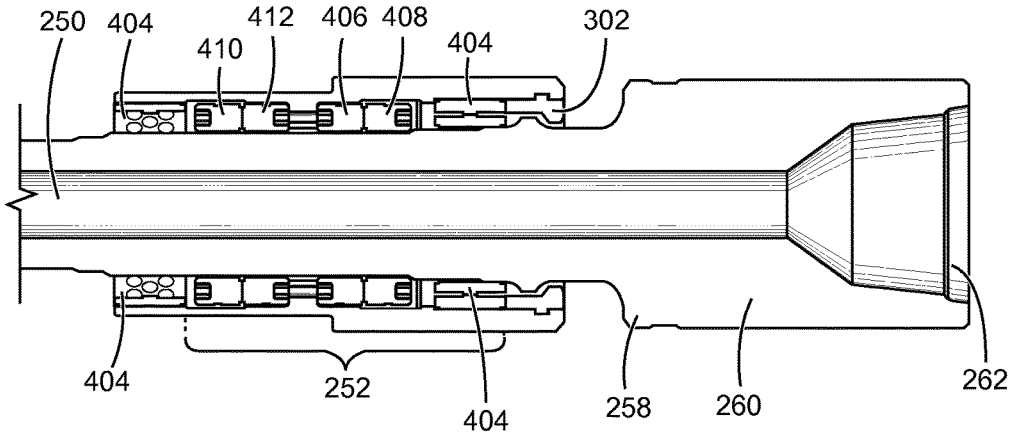
FIG. 4B is a side view of a portion of a mud motor illustrating bearing set mounting in accordance with some embodiments.

FIG. 4B is a side view of a portion of a mud motor 136 illustrating a bearing set 252 mounting, retaining assembly 302, and driveshaft 250 with tonging area 258 and tool joint 260. The connection 262 including an API drill string rotary shouldered connection with a tapered end in accordance with some embodiments. FIG. 4B further illustrates a shaft side 404 of the radial bearings described above with reference to FIG. 4A, in addition to alternate views of on-bottom axial bearings 406, 408, and off-bottom axial bearings 410, 412 for showing mounting thereof.

Figure 5:
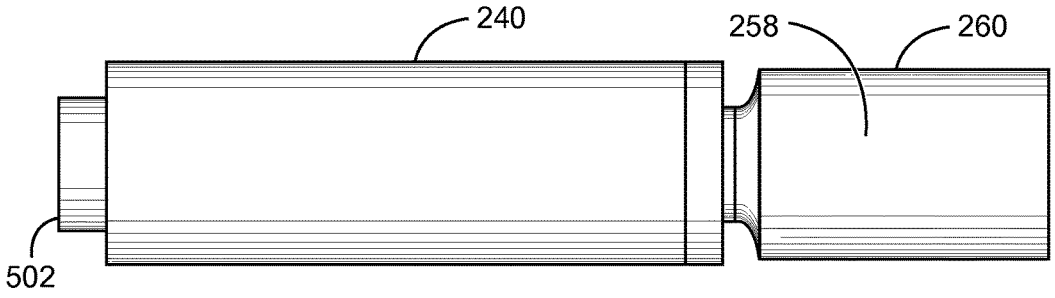
FIG. 5 is a side view of a portion of a mud motor in accordance with some embodiments.

FIG. 5 is a side view of a portion of a mud motor 136 in accordance with some embodiments that depicts the power section stator 240, within which is housed the rotor assembly 254 and portions of the driveshaft 250 described earlier herein with reference to FIG. 2B. A top subassembly 502 couples the power section stator 240 and inner workings of the rotor assembly 254 to a drill string 108 (FIG. 1). The tonging area 258 and tool joint 260 are connected outside the power section stator 240.

Figure 6:
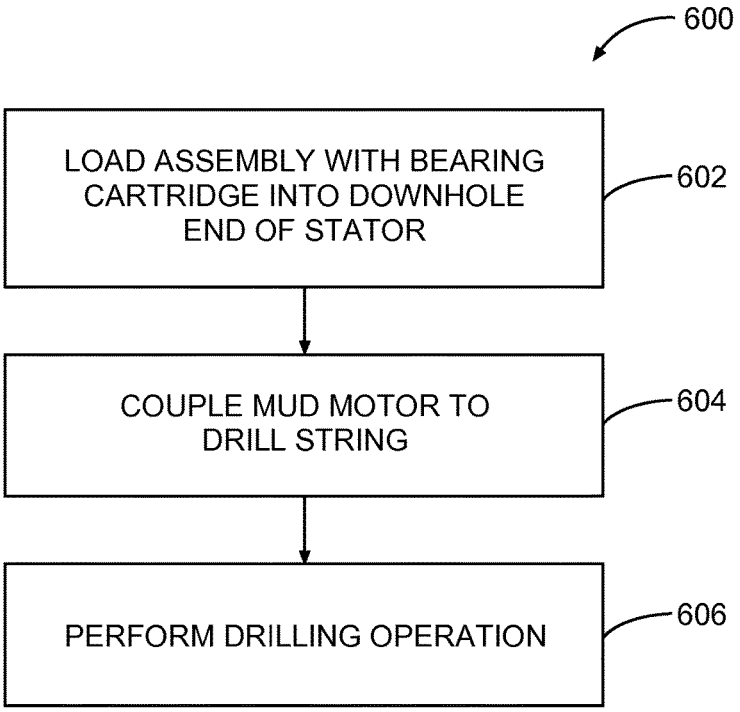
FIG. 6 is a flowchart showing an embodiment of a method for using a mud motor of some embodiments.

FIG. 6 is a flowchart showing an embodiment of a method 600 for assembling a portion of a mud motor 136 and operating the mud motor 136. The example method 600 is described herein with reference to elements shown in FIGS. 1, 2B, and 3-5. Some operations of example method 600 can be performed in whole or in part by a mud motor 136 or any component of system 100 (FIG. 5), although embodiments are not limited thereto.

The example method 600 begins with operation 602 by loading a rotor assembly 254 into a first end, for example a downhole end 256, of an internal cavity of a power section stator 240 to construct a motor assembly (e.g., a portion of a mud motor 136). As described earlier herein with reference to FIG. 2B, the rotor assembly 254 includes a power section rotor 246, a drivetrain 248 operably coupled to the power section rotor 246, and a bearing set 252, such that the rotor assembly 254 is fully encased in the internal cavity of the power section stator 240.

The example method 600 continues with operation 604 by coupling the motor assembly to a drill string 108.

The example method 600 continues with operation 606 by introducing a drilling fluid into a second end of the internal cavity of the power section stator 240.

The example method 600 continues with operation 608 by forcing the drilling fluid through a cavity between the power section stator 240 and power section rotor 246 with sufficient pressure to cause the power section rotor 246 to rotate relative to the power section stator 240 to provide a torque force to a drill bit 118 coupled to a driveshaft 250 coupled to the drivetrain 248. As described earlier herein with reference to FIG. 2B, on bottom and off-bottom loads can be carried into the power section stator 240 through the retaining assembly 302.

As mentioned earlier herein, a cartridge system of mounting can have other benefits in assembly related to pre-assembly and bench testing of rotor assembly 254 components. For example, bench testing can be performed to test push-pull bearing preload, to inspect connection torque markings, to test assembled lengths, and to confirm assembly of rotor assembly 254 components or other components.

Referring again to FIG. 1, the system 100 can further include a surface system 138 for storage, processing, and analysis of measurements taken by tools on the bottom hole assembly 110 or for providing control to the mud motor 136 or drill bit 118. The surface system 138 may be provided with electronic equipment, for example a processor, for various types of signal processing, which may be implemented by any one or more of the components of the bottom hole assembly 110. Formation evaluation data may be gathered and analyzed during drilling operations (e.g., during LWD operations, and by extension, sampling while drilling). The surface system 138 can include a workstation 140 with a display 142.

Any of the above components, for example the mud motor 136, etc., may all be characterized as "modules" herein. The illustrations of mud motor 136 power section and drill bit components and system 100 are intended to provide a general understanding of the structure of various embodiments, and they are not intended to serve as a complete description of all the elements and features of apparatus and systems that might make use of the structures described herein. It should be noted that the methods described herein do not have to be executed in the order described, or in any particular order. Moreover, various activities described with respect to the methods identified herein can be executed in iterative, serial, or parallel fashion.

In summary, using the apparatus, systems, and methods disclosed herein may provide access to serviceable components of mud motors while enhancing fatigue endurance of the housing and lowering the cost of service life of the mud motor and of the housing. Embodiments provide for extending of the power section stator 240 for the purpose of eliminating threaded connections at the position of very high bending loads. Other portions of the mud motor 136 used for mud motor function are loaded into a single available opening, and these portions of the mud motor 136 are retained in the bottom of the elongated power section stator 240. These advantages can significantly enhance the value of the services provided by an operation/exploration company, while at the same time controlling time-related costs.

Further examples of apparatuses, methods, a means for performing acts, systems or devices include, but are not limited to:

Example 1 is a motor or other apparatus comprising a power section stator having a first end, a second end, and an internal cavity passing therethrough; and a rotor assembly positioned in the internal cavity, the rotor assembly including a power section rotor having rotor lobes to cooperate with one or more stator lobes of the power section stator, a drivetrain operably coupled to the power section rotor, and a bearing set, wherein the power section rotor is positioned at the first end within the internal cavity of the power section stator, and wherein the power section rotor, the drivetrain, and the bearing set are fully encased in the internal cavity of the power section stator.

Example 2 may include or use, or may optionally be combined with the subject matter of Example 1 to further comprise a retaining assembly at the second end of the power section stator to retain the rotor assembly inside the internal cavity.

Example 3 may include or use, or may be optionally be combined with the subject matter of Example 2 wherein the retaining assembly includes a threaded bushing coupled around an outside circumference of the second end of the power section stator.

Example 4 may include or use, or may be optionally combined with the subject matter of Example 2, wherein the retaining assembly includes a threaded bushing coupled around an inside circumference of the second end of the power section stator.

Example 5 may include or use, or may be optionally combined with the subject matter of Example 2, wherein the retaining assembly includes a compression ring coupled around an outside circumference of the second end of the power section stator.

Example 6 may include or use, or may be optionally combined with the subject matter of Example 2, wherein the retaining assembly includes a compression ring circumferentially coupled around an inside diameter of the second end of the power section stator.

Example 7 may include or use, or optionally be combined with any one or more of Examples 1-6 wherein the rotor assembly is loaded against a shoulder portion spaced a distance from the second end inside the internal cavity.

Example 8 may include or use, or optionally be combined with any one or more of Examples 1-7 and further comprising a driveshaft coupled to the drivetrain at the second end of the power section stator, and wherein a first portion of the driveshaft is enclosed within the power section stator and a tonging area of the driveshaft is not enclosed within the power section stator.

Example 9 may include or use, or optionally be combined with any one or more of Examples 1-8 wherein the rotor assembly is mounted as a cartridge within the internal cavity.

Example 10 may include or use, or optionally be combined with any one or more of Examples 1-9, further comprising a saver subassembly.

Example 11 is a system, which can include portions of any of Examples 1-10, comprising: a drill string; a motor assembly coupled to the drill string through a rotary shouldered connection, the motor assembly including a power section stator having a first end, a second end, and an internal cavity passing therethrough, and a rotor assembly positioned and fully encased in the internal cavity, the rotor assembly including a power section rotor having rotor lobes to cooperate with one or more stator lobes of the power section stator, a drivetrain operably coupled to the power section rotor, and a bearing set, wherein the power section rotor is positioned at the first end within the internal cavity of the power section stator, and wherein the power section rotor, the drivetrain, and the bearing set are fully encased in the internal cavity of the power section stator; and a drill bit coupled to the drivetrain through a driveshaft.

Example 12 can include the subject matter of Example 11, wherein the motor assembly further includes a retaining assembly at the second end of the power section stator to retain the rotor assembly inside the internal cavity.

Example 13 can include the subject matter of any one of Examples 11-12, wherein the retaining assembly includes a threaded bushing coupled around a circumference of the second end of the power section stator.

Example 14 can include the subject matter of any one of Examples 11-12, wherein the retaining assembly includes a compression ring coupled around a circumference of the second end of the power section stator.

Example 15 can include the subject matter of any one of Examples 11-14, and further comprising a surface system including a processor to control the motor assembly and the drill bit.

Example 16 is a method of operating a motor in a well drilling operation, the method comprising, wherein any of Examples 1-15 can include means for performing the method of Example 16, and wherein the method of Example 16 comprises loading a rotor assembly into a first end of an internal cavity of a power section stator, the rotor assembly including a power section rotor, a drivetrain operably coupled to the power section rotor, and a bearing set, such that the rotor assembly is fully encased in the internal cavity of the power section stator, to construct a motor assembly; coupling the motor assembly to a drill string; introducing a drilling fluid into a second end of the internal cavity of the power section stator; and forcing the drilling fluid through a cavity between the power section stator and power section rotor with sufficient pressure to cause the power section rotor to rotate relative to the power section stator to provide a torque force to a drill bit coupled to a driveshaft coupled to the drivetrain.

Example 17 includes the subject matter of Example 16, and further comprising performing a bench test of the motor assembly subsequent to loading the rotor assembly and prior to coupling the motor assembly to the drill string.

Example 18 includes the subject matter of Example 17, wherein the bench test includes a test of push-pull bearing preloads.

Example 19 includes the subject matter of any of Examples 16-18, wherein the rotor assembly further includes a retaining assembly at the second end of the power section stator to retain the rotor assembly inside the internal cavity, wherein the retaining assembly includes a threaded bushing coupled around a circumference of the second end of the power section stator, and wherein the method further includes carrying an off-bottom load into the power section stator through the threaded bushing.

Example 20 includes the subject matter of any of Examples 16-19, wherein loading the rotor assembly includes mounting the rotor assembly as a cartridge within the internal cavity.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

Although specific embodiments have been illustrated and described herein, it will be appreciated by those of ordinary skill in the art that any arrangement that is calculated to achieve the same purpose may be substituted for the specific embodiments shown. Various embodiments use permutations or combinations of embodiments described herein. It is to be understood that the above description is intended to be illustrative, and not restrictive, and that the phraseology or terminology employed herein is for the purpose of description. Combinations of the above embodiments and other embodiments will be apparent to those of ordinary skill in the art upon studying the above description.

What is claimed is:

1. A motor comprising:

a power section stator comprising a single body having a first end, a second end, and an internal cavity passing therethrough;

a cartridge assembly fully encased in the internal cavity of the single body, the cartridge assembly comprising:

a rotor assembly positioned in the internal cavity, the rotor assembly including a power section rotor having rotor lobes to cooperate with one or more stator lobes of the power section stator, a drivetrain operably coupled to the power section rotor, and a bearing set;

wherein the cartridge assembly is capable of being loaded as a single unit into the internal cavity through the first end.

2. The motor of claim 1, further comprising a retaining assembly at the second end of the single body to retain the cartridge assembly inside the internal cavity.

3. The motor of claim 2, wherein the retaining assembly includes a threaded bushing coupled around an outside circumference of the second end of the single body.

4. The motor of claim 2, wherein the retaining assembly includes a threaded bushing coupled around an inside circumference of the second end of the single body.

5. The motor of claim 2, wherein the retaining assembly includes a compression ring coupled around an outside circumference of the second end of the single body.

6. The motor of claim 2, wherein the retaining assembly includes a compression ring circumferentially coupled around an inside diameter of the second end of the single body.

7. The motor of claim 1, wherein the rotor assembly is loaded against a shoulder portion spaced a distance from the second end inside the internal cavity.

8. The motor of claim 1, further comprising a driveshaft coupled to the drivetrain at the second end of the single body, and wherein a first portion of the driveshaft is enclosed within the power section stator and a tonging area of the driveshaft is not enclosed within the power section stator.

9. The motor of claim 1, further comprising a saver subassembly.

10. A system comprising:

a drill string;

a motor assembly coupled to the drill string through a rotary shouldered connection, the motor assembly including a power section stator comprising a single body having a first end, a second end, and an internal cavity passing therethrough, a cartridge assembly fully encased in the internal cavity of the single body, the cartridge assembly comprising:

a rotor assembly positioned and fully encased in the internal cavity, the rotor assembly including a power section rotor having rotor lobes to cooperate with one or more stator lobes of the power section stator, a drivetrain operably coupled to the power section rotor, and a bearing set, and wherein the cartridge assembly is capable of being loaded as a single unit into the internal cavity through the first end; and a drill bit coupled to the drivetrain through a driveshaft.

11. The system of claim 10, wherein the motor assembly further includes a retaining assembly at the second end of the single body to retain the cartridge assembly inside the internal cavity.

12. The system of claim 11, wherein the retaining assembly includes a threaded bushing coupled around a circumference of the second end of the single body.

13. The system of claim 11, wherein the retaining assembly includes a compression ring coupled around a circumference of the second end of the single body.

14. The system of claim 10, further comprising: a surface system including a processor to control the motor assembly and the drill bit.

15. A method of operating a motor in a well drilling operation, the method comprising:

loading a cartridge assembly comprising a rotor assembly and a bearing set into a first end of an internal cavity of a single body of a power section stator as a single unit, the rotor assembly including a power section rotor, a drivetrain operably coupled to the power section rotor, and the bearing set, such that the cartridge assembly is fully encased in the internal cavity of the single body, to construct a motor assembly; coupling the motor assembly to a drill string;

introducing a drilling fluid into a second end of the internal cavity of the single body; and forcing the drilling fluid through a cavity between the power section stator and power section rotor with sufficient pressure to cause the power section rotor to rotate relative to the power section stator to provide a torque force to a drill bit coupled to a driveshaft coupled to the drivetrain.

16. The method of claim 15, further comprising: performing a bench test of the motor assembly subsequent to loading the rotor assembly and prior to coupling the motor assembly to the drill string.

17. The method of claim 16, wherein the bench test includes a test of push-pull bearing preloads.

18. The method of claim 15, wherein the rotor assembly further includes a retaining assembly at the second end of the single body to retain the cartridge assembly inside the internal cavity, wherein the retaining assembly includes a threaded bushing coupled around a circumference of the second end of the single body, and wherein the method further includes carrying an off-bottom load into the power section stator through the threaded bushing.

* * * * *